United States Patent [19]

Metzler

[11] Patent Number: 4,628,545

[45] Date of Patent: Dec. 16, 1986

[54] APPAREL ARTICLE HAVING ZIPPER CONNECTION AND ITS METHOD FOR FABRICATING

[75] Inventor: Herbert Metzler, Balgach, Switzerland

[73] Assignee: Metzler & Co. AG, Balgach, Switzerland

[21] Appl. No.: 707,214

[22] Filed: Mar. 1, 1985

[51] Int. Cl.[4] ..... A44B 19/34; A41B 1/08

[52] U.S. Cl. ..... 2/265; 2/234; 112/265.2; 24/432

[58] Field of Search ..... 112/265.2, 104, 113, 112/147, 151; 2/218, 265, 234; 24/432

[56] References Cited

U.S. PATENT DOCUMENTS

| | | | |
|---|---|---|---|
| 2,176,229 | 10/1939 | Siegel | 24/432 X |
| 2,277,832 | 3/1942 | Rhoads et al. | 2/234 |
| 3,174,201 | 3/1965 | Roseman | 2/265 |
| 3,187,346 | 6/1965 | Jacobson | 2/234 |
| 3,605,665 | 9/1971 | Donald | 112/265.2 |
| 3,777,314 | 12/1973 | Boser | 2/265 |
| 3,795,920 | 3/1974 | Bernard | 2/234 |
| 3,962,729 | 6/1976 | Cook | 2/265 |
| 4,534,067 | 8/1985 | Richardson | 2/234 |

FOREIGN PATENT DOCUMENTS 595068 1/1978 Switzerland .

*Primary Examiner*—Werner H. Schroeder
*Assistant Examiner*—Andrew M. Falk
*Attorney, Agent, or Firm*—Werner W. Kleeman

[57] ABSTRACT

First and second panels are removed from a length of apparel fabric. Each panel is folded so as to form suitable pleats and folds in the mutually adjoining edge regions of the panels. Both zipper halves are preferably simultaneously inserted into one of the pleats. Each folded and pleated panel together with its associated zipper half are stitched together, for instance by means of a sewing machine head. During performance of the foregoing operations the first and second panels are removed from adjacent regions of the apparel fabric, folded, pleated and stitched to the associated zipper half such that substantial continuity of visual patterns in the fabric is substantially uniformly maintained from one panel across the zipper connection to the other panel. In a preferred embodiment, a strip of reinforcing fabric is incorporated in an outer lap formed by a hem fold of one of the panels.

26 Claims, 5 Drawing Figures

APPAREL ARTICLE HAVING ZIPPER CONNECTION AND ITS METHOD FOR FABRICATING

BACKGROUND OF THE INVENTION

The present invention broadly relates to zipper joins or connections for garments and, more specifically, pertains to a new and improved configuration of a zipper join or connection for an article of apparel, especially shirts and blouses, and a new and improved method of fabricating the zipper join or connection. The present invention also pertains to an article of apparel comprising the new and improved zipper join or connection and a method of fabricating such an article of apparel.

Generally speaking, the zipper join or connection of the present invention comprises a zipper fastener having a first zipper half and a second zipper half, an edge region of a first panel of apparel fabric, an edge region of a second panel of apparel fabric, an outwardly returned simple hem fold at the edge region of the first panel and an inwardly returned simple hem fold at the edge region of the second panel.

The method for forming the zipper join or connection comprises the steps of outwardly returning a first simple hem fold at an edge region of a first panel of apparel fabric and inwardly returning a second simple hem fold at an edge region of a second panel of apparel fabric.

The article of apparel of the present invention has a zipper join or connection comprising a zipper fastener having a first zipper half and a second zipper half, a first panel of apparel fabric having an edge, a second panel of apparel fabric having an edge, an outwardly returned first simple hem fold and an inwardly returned second simple hem fold.

The method of the present invention for fabricating an article of apparel having a zipper join comprises the steps of removing a first panel and a second panel for the article of apparel from a length of apparel fabric such that the first panel and the second panel each have a respective join edge, forming an outwardly returned first simple hem fold in the first panel and forming an inwardly returned second simple hem fold in the second panel to form an outer lap.

It is known to the art, for instance from the commonly assigned Swiss Pat. No. 595,068, patented Sept. 30, 1977, to employ zipper fasteners in shirts and blouses. Heretofore known zipper joins or connections of this type have the disadvantage that economically feasible configurations fail to provide or reliably ensure continuity of a visual pattern of the apparel fabric from one panel across the zipper join or connection to the other panel.

Articles of apparel, especially shirts and blouses, are often provided with woven or imprinted patterns. Such patterns generally have characteristics such as stripes which extend either longitudinally of the article of apparel, i.e. vertically, or laterally to the article of apparel, i.e. horizontally, or both. It is esthetically desirable for lateral elements of the pattern to maintain linear continuity across the full width of the article of apparel. It is undesirable for such lateral elements to be out of register, i.e. longitudinally misaligned, across the zipper join or connection. Longitudinally extending pattern elements generally exhibit repetitive characteristics characterized by a uniform lateral pitch or pitch spacing. It is desirable for the pitch spacing of such longitudinally extending pattern elements to continue uniformly across the zipper join or connection without interruption or alteration of the pitch spacing. Heretofore known zipper joins or connections for articles of apparel and methods for fabricating such zipper joins or connections do not guarantee the above-mentioned types of continuity of the visual pattern.

SUMMARY OF THE INVENTION

Therefore, with the foregoing in mind, it is a primary object of the present invention to provide a new and improved configuration of a zipper join or connection for apparel and a method for fabricating such a zipper join or connection which do not exhibit the aforementioned drawbacks and shortcomings of the prior art articles and methods.

Another and more specific object of the present invention aims at providing a new and improved configuration of a zipper join or connection for apparel of the previously mentioned type in which laterally extending pattern elements of the apparel fabric are in longitudinally registering alignment on both sides of the zipper join or connection and in which the pitch spacing of longitudinally extending pattern elements remains uniform across the zipper join or connection.

Yet a further significant object of the present invention aims at providing a new and improved configuration of a zipper join or connection of the character described which is relatively simple in design, extremely economical to fabricate, highly reliable in use, not readily subject to breakdown or malfunction and requires a minimum of attention.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
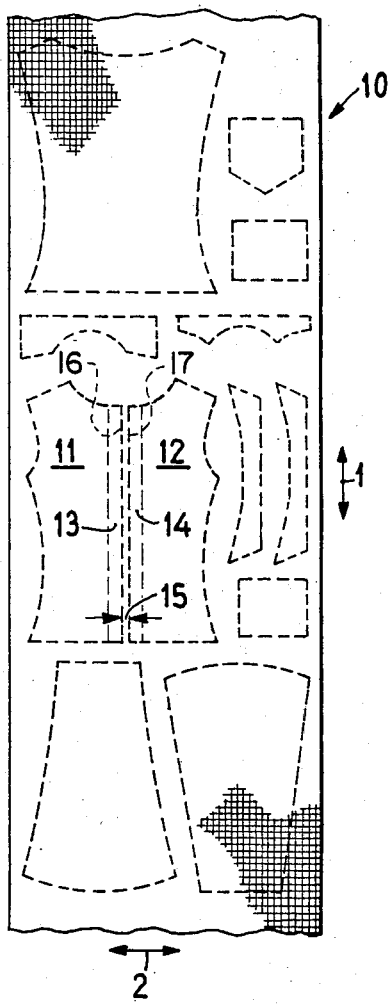
FIG. 1 schematically shows a length of apparel fabric with the portions of a shirt or blouse marked out thereupon for removal and further processing.

The zipper join or connection of the present invention is manifested by the features that the first zipper half of the zipper fastener is located outwardly adjacent to the outwardly returned first simple hem fold of the first panel, the second zipper half of the zipper fastener is located inwardly adjacent to the inwardly returned second simple hem fold of the second panel, an inward substantially parallel pleat is provided in the first panel outwardly overlapping the first zipper half and the outwardly returned first simple hem fold, an outward substantially parallel pleat is provided in the second panel inwardly overlapping the second zipper half and the inwardly returned second simple hem fold for forming an outer lap, a suitable stitch, such as a chain-stitch extends longitudinally through the inward parallel pleat, the first zipper half and the first simple hem fold for uniting the first zipper half to the first panel as well as for fixing the inward parallel pleat and the first simple hem fold, a further suitable stitch, such as a chain-stitch extends longitudinally through the outward parallel pleat, the second zipper half and the second simple hem fold for uniting the second zipper half to the second panel as well as for fixing the outward parallel pleat and the second simple hem fold, and the first zipper half releasably engages the second zipper half for releasably joining or connecting the first panel to the second panel.

The method of the present invention for forming a zipper join or connection for apparel is manifested by the features that it comprises the steps of forming an inward substantially parallel pleat in the first panel, forming an outward substantially parallel pleat in the second panel, inserting the first simple hem fold into the inward parallel pleat, inserting the second simple hem fold into the outward parallel pleat, inserting a first zipper half between the first simple hem fold and the inward parallel pleat, inserting a second zipper half between the second simple hem fold and the outward parallel pleat, stitching through the first simple hem fold, the first zipper half and the inward parallel pleat for uniting the first zipper half to the first panel as well as for fixing the first simple hem fold and the inward parallel pleat, stitching through the second simple hem fold, the second zipper half and the outward parallel pleat for uniting the first zipper half to the first panel as well as for fixing the second simple hem fold and the outward parallel pleat, and zipping together the first zipper half and the second zipper half.

The article of apparel having a zipper join or connection of the present invention is manifested by the features that it comprises an inward pleat extending in substantially parallel spaced relationship to the edge of the first panel, an outward pleat extending in substantially parallel spaced relationship to the edge of the second panel, the outwardly returned first simple hem fold being tucked into the inward pleat, the inwardly returned second simple hem fold being tucked into the outward pleat to form an outer lap, the first zipper half being located within the inward pleat and adjacent to the tucked-in first simple hem fold, the second zipper half being located within the outward pleat and adjacent to the tucked-in second simple hem fold, a first stitch, such as a chain-stitch extending in substantially parallel spaced relationship to the inward pleat and penetrating the inward pleat, the first zipper half and the tucked-in first simple hem fold for uniting the first zipper half to the first panel as well as for fixing the inward pleat and the first simple hem fold, a second stitch, such as a chain-stitch extending in substantially parallel spaced relationship to the outward pleat and penetrating the outward pleat, the first zipper half and the tucked-in second simple hem fold for uniting the second zipper half to the second panel as well as for fixing the outward pleat and the second simple hem fold, and the first zipper half releasably engages the second zipper half for releasably joining the first panel to the second panel of the article of apparel.

The method of the present invention for fabricating an article of apparel having a zipper join or connection is manifested by the features that it comprises the steps of forming an inward pleat in the first panel in substantially parallel spaced relationship to the join edge thereof, forming an outward pleat in the second panel in substantially parallel spaced relationship to the join edge thereof, inserting the outwardly returned first simple hem fold into the inward pleat, inserting the inwardly returned second simple hem fold into the outward pleat to form an outer lap, inserting a first zipper half into the inward pleat between the inward pleat and the first simple hem fold, inserting a second zipper half matched to said first zipper half into the outward pleat between the outward pleat and the second simple hem fold, stitching, such as chain-stitching the inward pleat together to anchor the first simple hem fold and the first zipper half therein, stitching, such as chain-stitching the outward pleat together to anchor the second simple hem fold and the second zipper half therein, zipping the first zipper half to the second zipper half for releasably joining the first and second panels and further processing the article of apparel to completion.

In a preferred embodiment of the invention, a reinforcing fabric insert is inserted into the outer lap before chain-stitching and is further stitched to the outer lap at the outer edge thereof. In a further preferred embodiment of the invention, measures are taken to assure that laterally extending elements of a visual pattern of the apparel fabric extend across the zipper join or connection in longitudinally registering alignment. In yet another preferred embodiment of the invention, measures are taken to assure that the pitch spacing of a longitudinally extending visual pattern of the apparel fabric is uniformly maintained across the zipper join or connection.

Turning now specifically to FIG. 1 of the drawings, a length of apparel fabric 10 will be seen to comprise components of an article of apparel, such as a shirt or blouse illustrated by way of example and not limitation. It will be understood that these components are marked out upon the length of fabric 10 in chalk or pencil or other suitable marking means manually or automatically as a guide for subsequent cutting out by manual or automatic shears or other suitable means. It will also be appreciated that the components of the article of apparel could be cut out from the length of apparel fabric 10 by means of a suitable numerically controlled laser cutting device and the operation of marking out dispensed with.

In particular, the length of apparel fabric 10 will be seen to comprise two opposite-handed panels 11 and 12 of an article of apparel such as a shirt or blouse. The first panel 11 comprises an edge region 13 and the second panel 12 comprises an edge region 14. These two edge regions 13 and 14 are intended to be mating edge regions of the finished article of apparel at which the zipper join or connection of the invention is to be provided and which will be releasably united by the zipper connection. The edge regions 13 and 14 are preferably disposed adjacently in the length of apparel fabric 10. While the two panels 11 and 12 could be situated more remote from one another in the lateral direction 2 of the length of apparel fabric 10, according to the invention they are situated in substantial alignment in the longitudinal direction 1 of the length of such apparel fabric 10.

There may be a space 15 defined between the two edge regions 13 and 14 of the first and second panels 11 and 12 respectively. The width of this space 15 is governed by the provisions of the invention in relation to characteristics of the length of apparel fabric 10, as will be explained in more detail hereinbelow.

Figure 2:
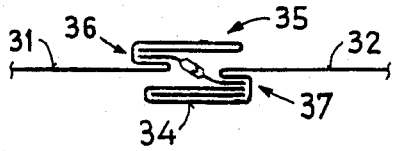
FIG. 2 schematically shows a lateral section taken through the zipper join or connection of the invention at the section line II—II of FIG. 3.

FIG. 2 shows a first panel 31 and a second panel 32 which have been removed from a length of apparel fabric such as the length of apparel fabric 10 but provided with a pattern. These first and second panels 31 and 32 may be, for instance, the right and left panels, respectively, of a shirt or blouse as considered from the standpoint of the wearer of the garment. A zipper connection 35 is conjointly formed by the edge regions 36 and 37 of the first and second panels 31 and 32 respectively. The detailed structure of the zipper connection 35 will be explained in relation to FIG. 5 hereinbelow.

Figure 3:
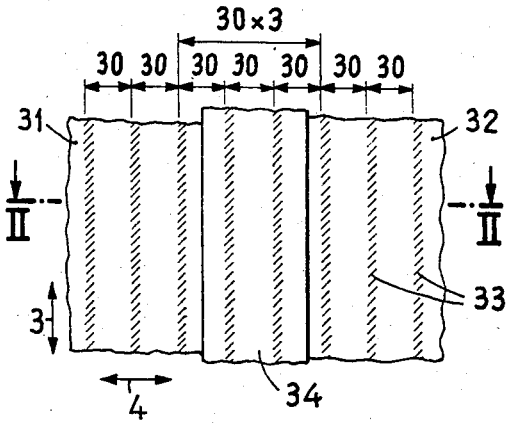
FIG. 3 schematically shows a frontal view of the zipper join or connection of the invention tailored in apparel fabric having a longitudinal pattern.

FIG. 3 shows a frontal view of the article of apparel, such as the shirt or blouse, shown in FIG. 2 and comprising the zipper connection 35 of the invention. The first panel 31 and the second panel 32 have been removed, as previously stated, from a length of patterned fabric such as the length of fabric 10 and which here exhibits a longitudinal visual pattern. In the illustrative example shown in FIG. 3, this longitudinal visual pattern takes the form of vertical stripes 33 in the article of apparel. These vertical stripes 33 exhibit a spacing or pitch 30 which repeats uniformly in the lateral direction 4 of the first and second panels 31 and 32. It will be seen from FIG. 3 that the outermost stripe 33 in the first panel 31 and the outermost stripe 33 in the second panel 32 are spaced apart by an integral number of lateral pitch spacings 30, in the illustrative embodiment three lateral pitch spacings 30. The vertical stripes 33 are also present in an outer lap 34 of the zipper connection 35. These vertical stripes 33 in the outer lap 34 also conform to the uniform lateral pitch spacing 30.

Figure 4:
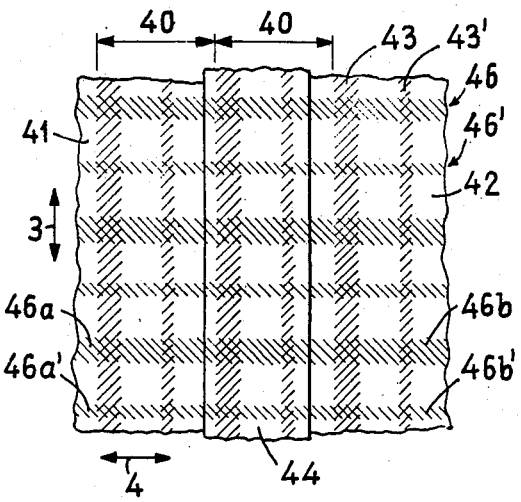
FIG. 4 schematically shows a frontal view of the zipper join or connection of the invention tailored in apparel fabric having a partially lateral pattern.

FIG. 4 is also a frontal view of an article of apparel, such as a shirt or blouse, the first and second panels 41 and 42 of which have been removed from a length of patterned apparel fabric such as the length of apparel fabric 10 and which here, however, exhibits a visual pattern with pattern elements extending in the lateral direction 4 of the first and second panels 41 and 42. These lateral pattern elements take the form of lateral or horizontal stripes 46 and 46'. The lateral stripes 46 and 46' extend in longitudinally registering alignment across the zipper connection 35. That is, the lateral stripes 46*a* and 46*a*' of the first panel 41 are in substantially registering alignment with the lateral stripes 46*b* and 46*b*' of the second panel 42. The lateral stripes 46 and 46' also extend through an outer lap 44 of the zipper connection 35 and conform to the same registering alignment.

In the illustrative example shown in FIG. 4, the visual pattern also exhibits pattern elements extending in the longitudinal or vertical direction 3 of the first and second panels 41 and 42 and taking the form of vertical stripes 43 and 43'. The fundamental lateral pitch spacing 40 of these vertical stripes 43 and 43' is different from the lateral pitch spacing 30 of FIG. 3.

Figure 5:
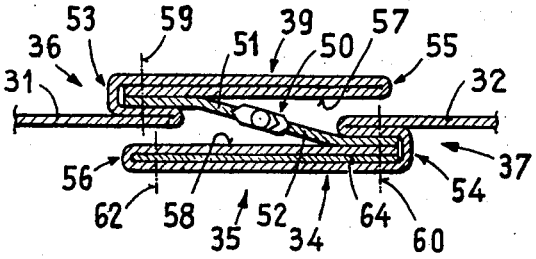
FIG. 5 schematically shows the zipper join or connection of FIG. 2 on an enlarged scale.

FIG. 5 shows the zipper connection 35 of FIG. 2 on an enlarged scale and in more detail. Hereinafter, the terms inner and inwardly will be understood to refer to a direction or to a side of the article of apparel adjacent to the body of a wearer, while the terms outer and outwardly will be understood to refer to a direction or to a side of the article of apparel facing the exterior.

It will be noted that the lateral sections illustrated in FIGS. 2 and 5 correspond to a man's shirt in which the outer lap 34 is attached to the left panel, in the illustrated instance the second panel 32. The invention can equally well be applied to women's blouses in which the handedness is reversed by simply forming the zipper connection 35 in mirror image. While the zipper connection 35 of the invention is illustrated as the zipper connection of a blouse or shirt, it can equally well be employed in other articles of apparel.

The zipper connection 35 comprises a zipper fastener 50 which can be separated into a first zipper half 51 and a second zipper half 52 and reunited at will. The first zipper half 51 is accommodated in an inward pleat 53 formed at the edge region 36 of the first panel 31 or 41 and extending longitudinally in substantially parallel spaced relationship to the outermost edge 16 of the apparel fabric. An outwardly returned simple hem fold 55 is also formed at the edge region 36 of the first panel 31 or 41 and is inserted or tucked into the inward pleat 53 conjointly with the first zipper half 51 to lie between this first zipper half 51 and the outwardly returned leg 57 of the simple hem fold 55. A stitch, preferably a chain stitch 59 extends through all three legs of the inward pleat 53, the outwardly returned leg 57 of the simple hem fold 55 and the first zipper half 51. This chain stitch 59 unites the first zipper half 51 to the first panel 31 or 41 of the article of apparel or garment. The chain stitch 53 also serves to fix the inward pleat 59 and the simple hem fold 55. The first panel 31 or 41 of the article of apparel is thus provided with a structure which incorporates the first zipper half 51, which presents an aesthetically neat appearance to the exterior and which also provides an inner lap 39 for preventing the teeth of the first zipper half 51 from inadvertently engaging underclothing or body hair or from coming into contact with bare skin.

The second zipper half 52 is similarly accommodated in an outward pleat 54 formed at the edge region 37 of the second panel 32 or 42 and extending longitudinally in substantially parallel spaced relationship to the outermost edge 17 of the apparel fabric. An inwardly returned simple hem fold 56 is formed at the edge region 37 of the second panel 32 or 42 and is tucked or inserted into the outward pleat 54 conjointly with the second zipper half 52. The inner leg 58 of the simple hem fold 56 thus lies between the second zipper half 52 and the outer leg of the simple hem fold 56. A stitch, preferably a chain-stitch 60 extends through all three legs of the outward pleat 54, the inwardly returned leg 58 of the simple hem fold 56 and the second zipper half 52. This chain stitch 60 unites the second zipper half 52 to the second panel 32 or 42 of the article of apparel. The chain stitch 60 also serves to fix the outward pleat 54 and the simple hem fold 56. The second panel 32 or 42 of the article of apparel is thus provided with a structure which incorporates the second zipper half 52 and which forms an outer lap 34 for covering the zipper connection 35 on the exterior to produce an aesthetically neat appearance.

In a preferred embodiment of the invention, a further stitch 62 extends through the outermost region of the inwardly returned simple hem fold 56 of the outer lap 34. This further stitch 62 serves to reinforce or stiffen the outer lap 34 and give it more body. In a further preferred embodiment of the invention, a reinforcing fabric insert 64 is incorporated within the outer lap 34 and is united with the apparel fabric of the outer lap 34 by the chain stitch 60 and the further stitch 62. This fabric insert 64 is preferably made of a material which is stiffer than the apparel fabric of the outer lap 34 and lends body to the outer lap, which might otherwise tend to be limp.

The first and second zipper halves 51 and 52 are preferably united with their respective panels 31 or 41 and 32 or 42 by means of the chain stitches 59 and 60. The advantage of chain-stitching is that the zipper halves 51 and 52 can be readily removed when repairs are required. Any other kind of stitch would render satisfactory replacement of the zipper fastener 50 difficult, although other types of stitches obviously can be used if this feature is not of that great importance.

The method of fabricating the zipper connection 35 of the present invention will now be explained in detail. A suitable cutting pattern for the size and style of the article of apparel or garment to be fabricated is chosen and transferred to a suitable length of fabric 10. This cutting pattern may be in the form of a template or other graphic device or may be a suitable numerical control program. The length of fabric 10 will in general be a segment of much longer fabric unwound from a roll. The length of fabric 10 has a longitudinal direction indicated by the double-headed arrow 1 and a lateral direction indicated by the double-headed arrow 2. FIG. 1 shows a suitable layout for the components of a shirt or blouse. It will be understood, however, that other layouts for shirts and blouses may be employed and that other types of apparel may be layed out on the length of fabric 10.

When laying or marking out the panels 11 and 12 which incorporate the zipper connection 35 in the completed article of apparel, the visual pattern of the length of apparel fabric 10 must be taken into account in relation to the completed article of apparel. If the article of apparel to be fabricated is devoid of visual pattern, i.e. is in plain color, then no special measures are required. It is nevertheless desirable to lay or mark out the two panels 11 and 12 in the same region of the length of apparel fabric 10 in order to ensure that there be no variation of color or texture between the two panels 11 and 12. In this case, the space 15 defined by the outermost edges 16 and 17 of the first and second panels 11 and 12, respectively, may have a zero width.

If the length of apparel fabric 10 exhibits a visual pattern having pattern elements extending substantially parallel to the lateral direction 2 of the length of fabric 10, then it is desirable to lay or mark out the first and second panels 11 and 12 upon the length of apparel fabric 10 in mutual longitudinal alignment in order that the laterally extending pattern elements, such as the lateral stripes 46 and 46', may be brought into substantially registering longitudinal alignment in the completed article of apparel.

If the length of apparel fabric 10 exhibits a visual pattern having pattern elements extending substantially parallel to the longitudinal direction 1 of the length of apparel fabric 10, such as the longitudinal stripes 33, then it is desirable to lay or mark out the first and second panels 11 and 12 upon the length of fabric 10 in lateral spaced relationship to one another such that, after removal of the first and second panels 11 and 12 from the length of apparel fabric 10 and fabrication of the zipper connection 35, the first and second panels 31 or 41 and 32 or 42 of the article of apparel can be releasably joined by the zipper fastener 50 without any discontinuity of the uniform pitch 30 of the longitudinally extending pattern elements, such as the longitudinal stripes 33.

The lateral width of the space 15 between the outermost edges 16 and 17 of the first and second panels 11 and 12, respectively, must therefore be determined in relation to the lateral pitch 30 of the visual pattern of the apparel fabric and in relation to the widths of the pleats and folds of the zipper connection 35. Depending on these parameters, the width of the space 15 may be between zero and one full pitch spacing 30 or 40.

It will be appreciated that the length of apparel fabric 10 may exhibit a visual pattern having pattern elements extending both substantially parallel to the longitudinal direction 1 and substantially parallel to the lateral direction 2 of the length of apparel fabric 10. In this case, the above-mentioned measures for ensuring longitudinal alignment and lateral continuity of pitch must both be employed in the fabrication process. Analogously, the length of apparel fabric 10 may exhibit a visual pattern having pattern elements extending in a different manner which again would require observing both of the above-mentioned measures.

The components of an article of apparel, for instance the first and second panels 11 and 12 of a shirt or blouse, are removed from the length of apparel fabric 10 by suitable means such as manual or automatic shears or a fabric-cutting, numerically-controlled laser beam. It will be appreciated that the first panel 11 and the second panel 12 now constitute components of the article of apparel which are matched with respect to color and texture, any laterally extending visual pattern elements and any longitudinally extending visual pattern elements. It is therefore usually essential or at least highly desirable that these two panels 11 and 12 remain associated with one another during the remainder of the fabrication process.

One zipper fastener 50 is assigned to the paired first and second panels 11 and 12. Although the first and second zipper halves 51 and 52, respectively, of the zipper fastener 50 are permanently longitudinally aligned, there may be a variation of this longitudinal alignment from one zipper fastener 50 to another. It is therefore important or at least highly desirable that the same zipper fastener 50, in particular the same first and second zipper halves 51 and 52, also remain associated with the same paired first and second panels 11 and 12 during the remaining fabrication steps.

The zipper fastener 50, which is delivered in the assembled condition of its constituent first and second zipper halves 51 and 52, is first attached to one of the first and second panels, such as 31 or 41 and 32 or 42. It is irrelevant whether the zipper fastener 50 be attached first to the first panel 31 or 41 or to the second panel 32 or 42. In this illustrative example it will be assumed that the first zipper half 51 is to be attached to the first panel 31 or 41. A simple hem fold 55 is outwardly returned at the edge region 36 of the first panel 31 or 41. That is, a narrow width of fabric is folded over to overlap the outward, visible face of the first panel 31 or 41. An inward pleat 53 is formed in the first panel 31 or 41 to overlap and conceal the free end of the simple hem fold 55. The first zipper half 51 is inserted into this inward pleat 53 such that it lies between the intermediate leg of the inward pleat 53 and the outer leg 57 of the simple hem fold 55.

The free edge of the first zipper half 51 is thus fully concealed and is sandwiched between double layers of fabric. The outer leg of the inward pleat 53, which is contiguous with the first panel 31 or 41, forms a narrow lap covering the outer side of the free edge of the first zipper half 51 while the inner leg of the inward pleat, which is contiguous with the inner face of the simple hem fold 55, forms, conjointly with the simple hem fold 55, a broad inner lap 39 which extends beyond the first zipper half 51 by a sufficient amount to completely cover the zipper connection 35 at the inner side and thereby prevent the zipper fastener 50 from inadvertently coming into contact with bare skin or engaging underclothing or body hair.

The inward pleat 53 may be formed before the outwardly returned simple hem fold 55 or subsequent to this outwardly returned simple hem fold 55 or simultaneously therewith. Since the inward pleat 53 and the outwardly returned simple hem fold 55 are relatively narrow fabric structures formed at a free edge of the first panel 31 or 41 to extend over the relatively great length of such first panel 31 or 41 and since their widths are critical in relation to the aforementioned pitch alignment or uniformity, care must be exercised when performing these folding operations either manually or with the aid of a suitable guide tool or jig.

The assemblage comprising the first zipper half 51 and the first panel 31 or 41 is then conducted to a conventional sewing head of a sewing machine and a suitable stitch, such as the chain-stitch 59 is passed through the first panel 31 or 41, the intermediate leg of the inward pleat 53, the first zipper half 51, the outwardly returned leg 57 of the simple hem fold 55 and the inner lap 39 formed by the simple hem fold 55 to anchor the first zipper half 51 in the inward pleat 53. The first zipper half 51 is thereby firmly united with the first panel 31 or 41. The chain stitch 59 also serves to permanently fix the inward pleat 53 and the outwardly returned simple hem fold 55.

The second zipper half 52 is analogously united with the second panel 32 or 42. A simple hem fold 56 is outwardly returned at the edge region 37 of the second panel 32 or 42. That is, a narrow width of apparel fabric is folded over to overlap the inward face of the second panel 32 or 42. An outward pleat 54 is formed in the second panel 32 or 42 to overlap and conceal the free end of the simple hem fold 56. The inner leg of the outward pleat 54, which is contiguous with the second panel 32 or 42, conceals the free end of the simple hem fold 56. The second zipper half 52 is inserted into the outward pleat 54 between the intermediate leg of the outward pleat 54 and the inner leg 58 of the simple hem fold 56.

The assemblage comprising the second zipper half 52 and the second panel 32 or 42 is then conducted to the sewing head of the sewing machine and a suitable stitch, such as the chain-stitch 60 is passed through the outer lap 34 formed by the simple hem fold 56, the inner leg 58 of the simple hem fold 56, the second zipper half 51, the intermediate leg of the outward pleat 54 and the second panel 32 or 42. The second zipper half 52 is therefore anchored between double layers of fabric and thereby firmly united with the second panel 32 or 42. The chain stitch 60 also serves to permanently fix the outward pleat 54 and the inwardly returned simple hem fold 56.

In a preferred embodiment of the invention, a further stitch 62 is passed through the outer lap 34 formed by the simple hem fold 56 and the inner leg 58 of such simple hem fold 56 at the outermost edge of the outer lap 34. This further stitch 62 serves to rigidify the otherwise limp outer lap 34.

In a further preferred embodiment of the invention, a strip of reinforcing fabric 64 is inserted into the outer lap 34 within the simple hem fold 56 to further reinforce or stiffen the outer lap 34. This fabric insert 64 is preferably of a material which is stiffer than the apparel fabric of the outer lap 34. The chain stitch 60 and the further stitch 62 unite this fabric insert 64 with the outer lap 34.

As previously mentioned, it is important or at least highly desirable that the same first and second panels 31 or 41 and 32 or 42 and the same first and second zipper halves 51 and 52 remain associated with one another throughout fabrication of the article of apparel or garment. To this end, it is convenient to leave the second zipper half 52 in engagement with the first zipper half 51 when uniting the zipper fastener 50 to, for instance, the first panel 31 or 41 and to remove the second zipper half 52 from the first zipper half 51 only when the second zipper half 52 is to be united with, for instance, the second panel 32 or 42. In this manner, fewer individual components have to be accounted for during fabrication. Conversely, if the zipper fastener 50 is first attached to the second panel 32 or 42, the first zipper half 51 may be left in engagement with the second zipper half 52 until the first zipper half 51 is to be united with the first panel 31 or 41. For the same reasons it is also convenient to reengage the first and second zipper halves 51 and 52 after the final chain-stitching operation. This unites the first and second panels 31 or 41 and 32 or 42 together and greatly reduces the risk of their being separated during further processing.

Once the zipper connection 35 is completed, the first and second panels 31 or 41 and 32 or 42 together with the installed zipper fastener 50 can be further processed and integrated into the desired article of apparel or garment. In particular, upper and lower edges of the first and second panels 31 or 41 and 32 or 42 may be stitched to other components of the article of apparel or may be formed as free edges with a simple or double or other suitable hem fold. The stitching at the seam or at the hem closes the end regions of the zipper connection 35.

While there are shown and described present preferred embodiments of the invention, it is to be distinctly understood that the invention is not limited thereto, but may be otherwise variously embodied and practiced within the scope of the following claims.

Accordingly, What I claim is:

1. A zipper connection for apparel, comprising:

a zipper fastener having a first zipper half and a second zipper half;

an edge region of a first panel of apparel fabric;

an outwardly returned simple hem fold at said edge region of said first panel;

said first zipper half of said zipper fastener being located outwardly adjacent to said outwardly returned simple hem fold of said first panel;

an inward substantially parallel pleat in said first panel outwardly overlapping said first zipper half and said outwardly returned simple hem fold;

a stitch extending longitudinally through said inward parallel pleat, said first zipper half and said hem fold for uniting said first zipper half to said first panel as well as for fixing said inward substantially parallel pleat and said hem fold;

an edge region of a second panel of apparel fabric;
an inwardly returned simple hem fold at said edge region of said second panel;
said second zipper half of said zipper fastener being located inwardly adjacent to said inwardly returned simple hem fold of said second panel;
an outward substantially parallel pleat in said second panel inwardly overlapping said second zipper half and said inwardly returned simple hem fold for forming an outer lap;
a stitch extending longitudinally through said outward parallel pleat, said second zipper half and said hem fold for uniting said second zipper half to said second panel as well as for fixing said outward substantially parallel pleat and said hem fold; and
said first zipper half releasably engaging said second zipper half for releasably joining said first panel to said second panel.

2. The zipper connection as defined in claim 1, further including:
a stitch extending longitudinally through said outer lap at an outermost edge thereof and serving for reinforcing said outer lap.

3. A zipper connection for apparel, comprising:
a zipper fastener having a first zipper half and a second zipper half;
an edge region of a first panel of apparel fabric;
an outwardly returned simple hem fold at said edge region of said first panel;
said first zipper half of said zipper fastener being located outwardly adjacent to said outwardly returned simple hem fold of said first panel;
an inward substantially parallel pleat in said first panel outwardly overlapping said first zipper half and said outwardly returned simple hem fold;
a stitch extending longitudinally through said inward parallel pleat, said first zipper half and said hem fold for uniting said first zipper half to said first panel as well as for fixing said inward substantially parallel pleat and said hem fold;
an edge region of a second panel of apparel fabric;
an inwardly returned simple hem fold at said edge region of said second panel;
said second zipper half of said zipper fastener being located inwardly adjacent to said inwardly returned simple hem fold of said second panel;
an outward substantially parallel pleat in said second panel inwardly overlapping said second zipper half and said inwardly returned simple hem fold for forming an outer lap;
a stitch extending longitudinally through said outward parallel pleat, said second zipper half and said hem fold for uniting said second zipper half to said second panel as well as for fixing said outward substantially parallel pleat and said hem fold;
said first zipper half releasably engaging said second zipper half for releasably joining said first panel to said second panel;
a stitch extending longitudinally through said outer lap at an outermost edge thereof and serving for reinforcing said outer lap;
an insert located within said outer lap for reinforcing said outer lap; and
said longitudinal stitch through said outward parallel pleat, said second zipper half and said hem fold as well as said longitudinal stitch through said outermost edge of said outer lap uniting said insert with said outer lap.

4. The zipper connection as defined in claim 3, wherein:
said insert comprises a reinforcing fabric which is relatively stiff in relation to said apparel fabric.

5. The zipper connection as defined in claim 3, wherein:
said insert comprises a reinforcing fabric which is relatively stiff in relation to said outer lap.

6. A zipper connection for apparel, comprising:
a zipper fastener having a first zipper half and a second zipper half;
an edge region of a first panel of apparel fabric;
an outwardly returned simple hem fold at said edge region of said first panel;
said first zipper half of said zipper fastener being located outwardly adjacent to said outwardly returned simple hem fold of said first panel;
an inward substantially parallel pleat in said first panel outwardly overlapping said first zipper half and said outwardly returned simple hem fold;
a stitch extending longitudinally through said inward parallel pleat, said first zipper half and said hem fold for uniting said first zipper half to said first panel as well as for fixing said inward substantially parallel pleat and said hem fold;
an edge region of a second panel of apparel fabric;
an inwardly returned simple hem fold at said edge region of said second panel;
said second zipper half of said zipper fastener being located inwardly adjacent to said inwardly returned simple hem fold of said second panel;
an outward substantially parallel pleat in said second panel inwardly overlapping said second zipper half and said inwardly returned simple hem fold for forming an outer lap;
a stitch extending longitudinally through said outward parallel pleat, said second zipper half and said hem fold for uniting said second zipper half to said second panel as well as for fixing said outward substantially parallel pleat and said hem fold;
said first zipper half releasably engaging said second zipper half for releasably joining said first panel to said second panel; and
each said stitch comprising a chain-stitch.

7. A method for forming a zipper connection for apparel, comprising the steps of:
outwardly returning a first simple hem fold at an edge region of a first panel of apparel fabric;
forming an inward substantially parallel pleat in said first panel;
tucking said first simple hem fold into said inward substantially parallel pleat;
inserting a first zipper half between said first simple hem fold and said inward substantially parallel pleat;
stitching through said first simple hem fold, said first zipper half and said inward substantially parallel pleat for uniting said first zipper half to said first panel as well as for fixing said first simple hem fold and said inward substantially parallel pleat;
inwardly returning a second simple hem fold at an edge region of a second panel of apparel fabric;
forming an outward substantially parallel pleat in said second panel;
tucking said second simple hem fold into said outward substantially parallel pleat;

inserting a second zipper half between said second simple hem fold and said outward substantially parallel pleat; and stitching through said second simple hem fold, said second zipper half and said outward substantially parallel pleat for uniting said first zipper half to said first panel as well as for fixing said second simple hem fold and said outward substantially parallel pleat.

8. The method as defined in claim 7, further including the step of:

zipping together said first zipper half and said second zipper half.

9. The method as defined in claim 8, further including the steps of:

aligning said first zipper half longitudinally with said first panel before stitching; and aligning said second zipper half longitudinally with said second panel before stitching such that said first panel and said second panel when zipped together after stitching are in substantially registering longitudinal alignment.

10. The method as defined in claim 7, wherein:

said step of outwardly returning the first simple hem fold is performed before said step of forming the inward substantially parallel pleat.

11. The method as defined in claim 7, wherein:

said step of outwardly returning the first simple hem fold is performed after said step of forming the inward substantially parallel pleat.

12. The method as defined in claim 7, wherein:

said step of inwardly returning the second simple hem fold is performed before said step of forming the outward substantially parallel pleat.

13. The method as defined in claim 7, wherein:

said step of inwardly returning the second simple hem fold is performed after said step of forming the outward substantially parallel pleat.

14. The method as defined in claim 7, wherein:

each stitching step entails forming chain-stitches.

15. A method for forming a zipper connection for apparel, comprising the steps of:

outwardly returning a first simple hem fold at an edge region of a first panel of apparel fabric;

forming an inward substantially parallel pleat in said first panel;

tucking said first simple hem fold into said inward substantially parallel pleat;

inserting a first zipper half between said first simple hem fold and said inward substantially parallel pleat;

stitching through said first simple hem fold, said first zipper half and said inward substantially parallel pleat for uniting said first zipper half to said first panel as well as for fixing said first simple hem fold and said inward substantially parallel pleat;

inwardly returning a second simple hem fold at an edge region of a second panel of apparel fabric;

forming an outward substantially parallel pleat in said second panel;

tucking said second simple hem fold into said outward substantially parallel pleat;

inserting a second zipper half between said second simple hem fold and said outward substantially parallel pleat;

stitching through said second simple hem fold, said second zipper half and said outward substantially parallel pleat for uniting said first zipper half to said first panel as well as for fixing said second simple hem fold and said outward substantially parallel pleat; and inserting an insert into said second simple hem fold before tucking said second simple hem fold into said outward substantially parallel pleat.

16. An article of apparel having a zipper connection, comprising:

a zipper fastener having a first zipper half and a second zipper half;

a first panel of apparel fabric having an edge;

an inward pleat extending in substantially parallel spaced relationship to said edge of said first panel;

an outwardly returned first simple hem fold tucked into said inward pleat;

said first zipper half being located within said pleat and adjacent to said tucked-in first simple hem fold;

a stitch extending in substantially parallel spaced relationship to said substantially inward pleat and penetrating said inward pleat, said first zipper half and said tucked-in first simple hem fold for uniting said first zipper half to said first panel as well as for fixing said inward pleat and said first simple hem fold;

a second panel of apparel fabric having an edge;

an outward pleat extending in substantially parallel spaced relationship to said edge of said second panel;

an inwardly returned second simple hem fold tucked into said outward pleat to form an outer lap;

said second zipper half being located within said pleat and adjacent to said tucked-in first simple hem fold;

a stitch extending in substantially parallel spaced relationship to said outward pleat and penetrating said outward pleat, said first zipper half and said tucked-in first simple hem fold for uniting said second zipper half to said second panel as well as for fixing said outward pleat and said second simple hem fold; and said first zipper half releasably engaging said second zipper half for releasably joining said first panel to said second panel of said article of apparel.

17. The article of apparel as defined in claim 16, further comprising:

a further stitch extending in substantially parallel spaced relationship to said edge of said second panel and closer thereto than said stitch and serving for reinforcing said outer lap.

18. An article of apparel having a zipper connection, comprising:

a zipper fastener having a first zipper half and a second zipper half;

a first panel of apparel fabric having an edge;

an inward pleat extending in substantially parallel spaced relationship to said edge of said first panel;

an outwardly returned first simple hem fold tucked into said inward pleat;

said first zipper half being located within said pleat and adjacent to said tucked-in first simple hem fold;

a stitch extending in substantially parallel spaced relationship to said substantially inward pleat and penetrating said inward pleat, said first zipper half and said tucked-in first simple hem fold for uniting said first zipper half to said first panel as well as for fixing said inward pleat and said first simple hem fold;

a second panel of apparel fabric having an edge;

an outward pleat extending in subtantially parallel spaced relationship to said edge of said second panel;

an inwardly returned second simple hem fold tucked into said outward pleat to form an outer lap;

said second zipper half being located within said pleat and adjacent to said tucked-in first simple hem fold;

a stitch extending in substantially parallel spaced relationship to said outward pleat and penetrating said outward pleat, said first zipper half and said tucked-in first simple hem fold for uniting said second zipper half to said second panel as well as for fixing said outward pleat and said second simple hem fold;

said first zipper half releasably engaging said second zipper half for releasably joining said first panel to said second panel of said article of apparel;

a further stitch extending in substantially parallel spaced relationship to said edge of said second panel and closer thereto than said stitch and serving for reinforcing said outer lap;

an insert located between said outward pleat and said inwardly returned second simple hem fold for reinforcing said outer lap; and said stitch and said further stitch for reinforcing said outer lap uniting said insert with said apparel fabric.

19. An article of apparel having a zipper connection, comprising:

a zipper fastener having a first zipper half and a second zipper half;

a first panel of apparel fabric having an edge;

an inward pleat extending in substantially parallel spaced relationship to said edge of said first panel;

an outwardly returned first simple hem fold tucked into said inward pleat;

said first zipper half being located within said pleat and adjacent to said tucked-in first simple hem fold;

a stitch extending in substantially parallel spaced relationship to said substantially inward pleat and penetrating said inward pleat, said first zipper half and said tucked-in first simple hem fold for uniting said first zipper half to said first panel as well as for fixing said inward pleat and said first simple hem fold;

a second panel of apparel fabric having an edge;

an outward pleat extending in substantially parallel spaced relationship to said edge of said second panel;

an inwardly returned second simple hem fold tucked into said outward pleat to form an outer lap;

said second zipper half being located within said pleat and adjacent to said tucked-in first simple hem fold;

a stitch extending in substantially parallel spaced relationship to said outward pleat and penetrating said outward pleat, said first zipper half and said tucked-in first simple hem fold for uniting said second zipper half to said second panel as well as for fixing said outward pleat and said second simple hem fold;

said first zipper half releasably engaging said second zipper half for releasably joining said first panel to said second panel of said article of apparel;

said apparel fabric having an at least partially laterally extending visual pattern;

said first panel of said apparel fabric and said first zipper half being longitudinally aligned; and said second panel of said apparel fabric and said second zipper half being longitudinally aligned such that when said first zipper half and said second zipper half are zipped together said at least partly laterally extending visual pattern of said first panel and of said second panel is in substantially registering longitudinally alignment at said zipper connection.

20. An article of apparel having a zipper connection, comprising:

a zipper fastener having a first zipper half and a second zipper half;

a first panel of apparel fabric having an edge;

an inward pleat extending in substantially parallel spaced relationship to said edge of said first panel;

an outwardly returned first simple hem fold tucked into said inward pleat;

said first zipper half being located within said pleat and adjacent to said tucked-in first simple hem fold;

a stitch extending in substantially parallel spaced relationship to said substantially inward pleat and penetrating said inward pleat, said first zipper half and said tucked-in first simple hem fold for uniting said first zipper half to said first panel as well as for fixing said inward pleat and said first simple hem fold;

a second panel of apparel fabric having an edge;

an outward pleat extending in substantially parallel spaced relationship to said edge of said second panel;

an inwardly returned second simple hem fold tucked into said outward pleat to form an outer lap;

said second zipper half being located within said pleat and adjacent to said tucked-in first simple hem fold;

a stitch extending in substantially parallel spaced relationship to said outward pleat and penetrating said outward pleat, said first zipper half and said tucked-in first simple hem fold for uniting said second zipper half to said second panel as well as for fixing said outward pleat and said second simple hem fold;

said first zipper half releasably engaging said second zipper half for releasably joining said first panel to said second panel of said article of apparel;

said apparel fabric having an at least partially longitudinally extending visual pattern;

said at least partially longitudinally extending visual pattern has a fundamental lateral pitch spacing; and said first zipper half being united to said first panel and said second zipper half being united to said second panel such that said fundamental lateral pitch is uniformly maintained from said first panel across said outer lap of the zipper connection to said second panel.

21. A method for fabricating an article of apparel having a zipper connection, comprising the steps of:

removing a first panel and a second panel for the article of apparel from a length of apparel fabric such that said first panel and said second panel each have a respective connection edge;

forming an inward pleat in said first panel in substantially parallel spaced relationship to said connection edge thereof;

inserting an outwardly returned first simple hem fold into said inward pleat;

inserting a first zipper half into said inward pleat between said inward pleat and said first simple hem fold;

stitching said inward pleat together to anchor said first simple hem fold and said first zipper half therein;

forming an outward pleat in said second panel in substantially parallel spaced relationship to said connection edge thereof;

inserting an inwardly returned second simple hem fold into said outward pleat to form an outer lap;

inserting a second zipper half matched to said first zipper half into said outward pleat between said outward pleat and said second simple hem fold;

stitching said outward pleat together to anchor said second simple hem fold and said second zipper half therein;

zipping said first zipper half to said second zipper half for releasably joining said first and second panels; and completing the article of apparel by stitching further panels of the article of apparel to said first and second panels.

22. The method as defined in claim 21, further including the step of:

inserting an insert into said second simple hem fold before tucking said second simple hem fold into said outward substantially parallel pleat.

23. The method as defined in claim 21, further including the steps of:

aligning said first zipper half longitudinally with said first panel before stitching; and aligning said second zipper half longitudinally with said second panel before stitching such that said first panel and said second panel when zipped together after stitching are in substantially registering longitudinal alignment.

24. The method as defined in claim 21, wherein:

said step of removing said first and second panels is performed at the same region of said length of apparel fabric.

25. The method as defined in claim 21, wherein:

said length of apparel fabric has an at least partially laterally extending visual pattern; and aligning said first zipper half with said first panel and aligning said second zipper half with said second panel such that when zipped together said at least partially laterally extending visual pattern of said apparel fabric is in substantially registering longitudinal alignment with said at least partially laterally extending visual pattern of said apparel fabric in said second panel.

26. The method as defined in claim 21, wherein:

said length of apparel fabric has an at least partially longitudinally extending visual pattern;

said at least partially longitudinally extending visual pattern having a fundamental lateral pitch spacing; and said steps of removing said first and second panels, forming said inward and outward pleats, inserting said first and second hem folds and inserting said first and second zipper halves being performed such that after stitching said fundamental lateral pitch spacing continues substantially uniformly from said first panel across said outer lap to said second panel.

* * * * *